US006641357B2

(12) United States Patent
Lindgren et al.

(10) Patent No.: US 6,641,357 B2
(45) Date of Patent: Nov. 4, 2003

(54) LATERALLY ADJUSTABLE LOAD CARRYING FORKS

(75) Inventors: Gunnar Lindgren, Eskilstuna (SE); Daniel Back, Eskilstuna (SE); Håkan Ripell, Skogstorp (SE)

(73) Assignee: Volvo Wheel Loaders AB, Eskilstuna (SE)

( * ) Notice: Subject to any disclaimer, the term of this patent is extended or adjusted under 35 U.S.C. 154(b) by 0 days.

(21) Appl. No.: 09/682,462

(22) Filed: Sep. 5, 2001

(65) Prior Publication Data

US 2002/0025246 A1 Feb. 28, 2002

Related U.S. Application Data

(62) Division of application No. 09/284,078, filed as application No. PCT/SE97/01673 on Oct. 7, 1997, now Pat. No. 6,287, 073.

(30) Foreign Application Priority Data

Oct. 7, 1996 (SE) ..... 9603655

(51) Int. Cl.[7] ..... B66F 9/14
(52) U.S. Cl. ..... 414/785; 412/544; 187/222
(58) Field of Search ..... 187/222, 237; 414/607, 608, 619–622, 662–664, 667, 911, 912, 920

(56) References Cited

U.S. PATENT DOCUMENTS

| | | | | | |
|---|---|---|---|---|---|
| 1,875,103 | A | * | 8/1932 | Mosel | 187/237 |
| 3,381,834 | A | * | 5/1968 | Gibson | 414/664 |
| 4,024,973 | A | * | 5/1977 | Siderits et al. | 214/674 |
| 6,287,073 | B1 | * | 9/2001 | Lindgren et al. | 414/785 |

* cited by examiner

*Primary Examiner*—Eileen D. Lillis
*Assistant Examiner*—Charles A. Fox
(74) *Attorney, Agent, or Firm*—Howrey Simon Arnold & White LLP

(57) ABSTRACT

A fork lift rack that includes a first beam, a second beam and at least two spacer elements which fix the first and second beams at a distance from and substantially parallel to each other is taught. The load-bearing fork members can be mounted on the first and second beams. The fork members can be displaced along the length of the beams. The fork members have first and second legs that extend in separate vertical planes. The fork members are designed such that the distance between the first legs is greater than the distance between the second legs when the two forks are mounted in place on the rack. The spacer elements have fastening devices which are intended to releaseably fasten the fork lift rack to a lift mechanism, the upper beam has a web and a flange which are joined to each other at an angle α different from 90°. The upper beam is joined to each spacer element via the web. The web is directed away from the lower beam.

14 Claims, 5 Drawing Sheets

LATERALLY ADJUSTABLE LOAD CARRYING FORKS

CROSS REFERENCE TO RELATED APPLICATIONS

The present application is a divisional application of U.S. Pat. No. 6,287,073, issued Sep. 11, 2001, which was a National Stage filing under 35 U.S.C. §371 of International Application No. PCT/SE97/01673, filed Oct. 7, 1997, which claims priority to Swedish Application No. 9603655-3, filed Oct. 7, 1996. The disclosure of each of these prior patent applications is hereby expressly incorporated in their entireties into this patent application by reference

BACKGROUND OF INVENTION

1. Technical Field

The present invention relates to a fork lift rack. More specifically, the invention relates to load-bearing fork members of the fork lift rack having an upper beam, a lower beam and at least two spacer elements that fix the upper and lower beams at a distance from and substantially parallel to each other. The load-bearing fork members are mountable on the upper and lower beams, and are displaceable along the length of the beams. The spacer elements have attachment means that are intended to releaseably attach the fork lift rack to a lift mechanism. The invention also relates to a fork intended to be mounted on a fork lift rack, comprising first and second legs, which form substantially right angles to each other, the first leg having a coupler or coupling means for coupling together with a first and a second beam of the fork lift rack, and the second leg having a load surface for carrying a load.

2. Background Information

Fork lift racks are known in the art and are used to fix the forks at a predetermined distance from each other. The fork lift rack typically comprises an anchor or anchoring means that makes it possible to fix the fork lift rack to the lift mechanism of, e.g., a wheel loader or a fork lift truck. In order to adjust the fork members to various objects to be lifted, the fork members are laterally displaceable along the fork lift rack.

However, when such a known fork lift rack is mounted on the lift mechanism of a wheel loader, the upper and lower beams of the fork lift rack block the sight of the operator, making it difficult for him to aim at and then insert the fork members under the object to be lifted, as well as place the object at its intended location. If the distance set between the fork members is small, the upright sections of the fork members also block the sight of the operator.

A fork lift rack is repeatedly placed under varying loads, subjecting the material in the fork lift rack to metal fatigue. The risk is greatest for fatigue cracking at the joints between the beams and the spacers.

SUMMARY OF INVENTION

The present invention provides a fork lift rack and a fork member that gives a large field of vision for an operator when the fork lift rack is mounted on the lift mechanism of the vehicle.

The present invention further provides a fork lift rack which has high fatigue strength.

A further purpose of the present invention is to provide a fork lift rack that permits the loading and unloading of an object on an inclined surface. This is achieved according to the invention by a web and a flange on the upper beam that are joined to each other at an angle $\alpha$ differing from 90°. The upper beam is joined to one or more spacer elements via the web, with the web being directed away from the lower beam. By making the web of the first beam inclined, the flange will be displaced downwards towards the lower beam. This means that the operator will be better able to see the fork members mounted on the rack when the lift mechanism is in its lower position.

According to one embodiment of the present invention, the fork members are displaceable relative to a coupler or coupling means that connects the fork members to the fork lift rack, permitting loading and unloading on inclined surfaces.

BRIEF DESCRIPTION OF DRAWINGS

The invention will be described in more detail below with reference to examples shown in the accompanying drawings, where.

DETAILED DESCRIPTION

Figure 1:
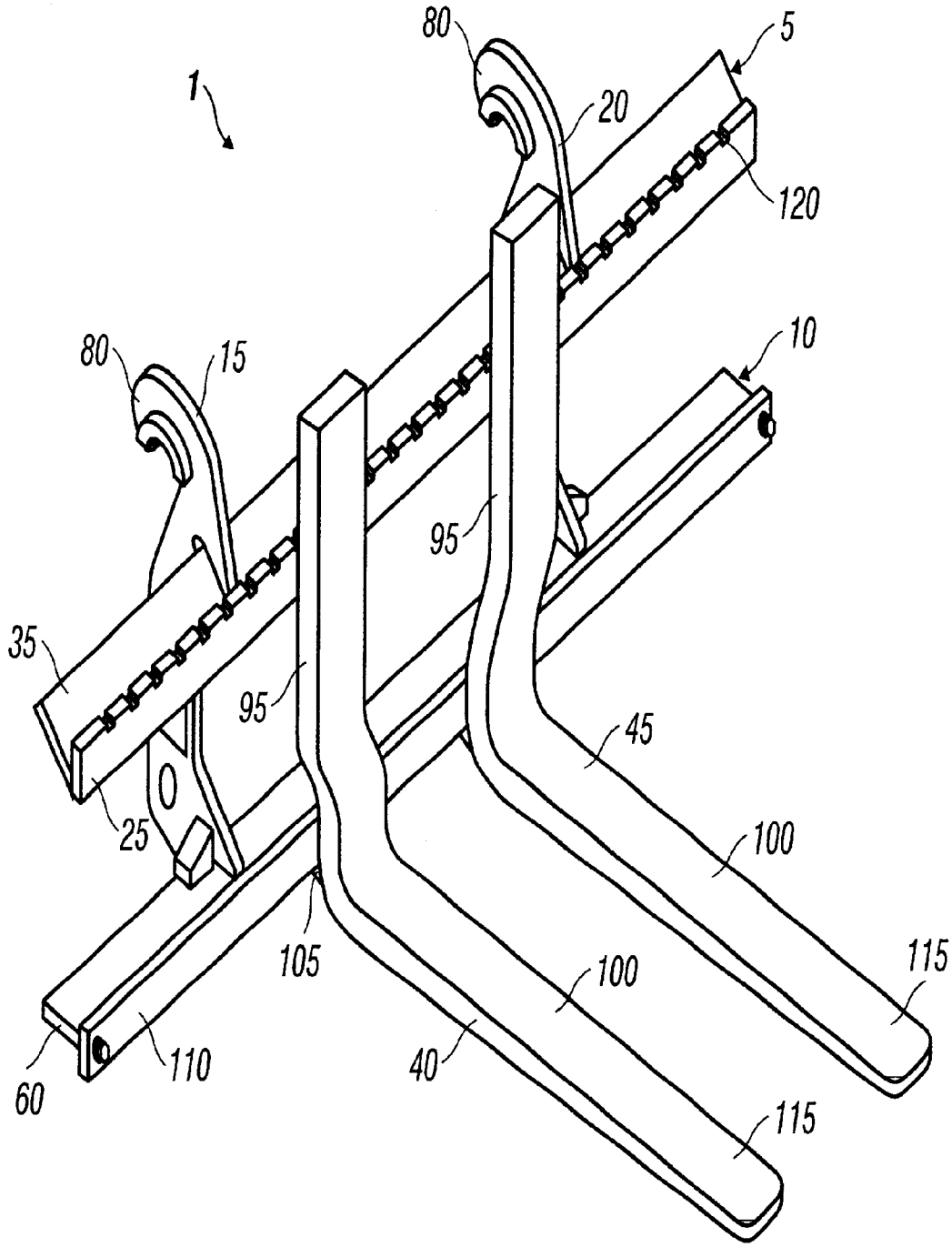
FIG. 1 illustrates a perspective view of a fork lift rack with fork members mounted on the rack.

FIGS. 1–4 illustrate one embodiment of a fork lift rack 1 having an upper beam 5 and a lower beam 10 that are fixed spaced from and substantially parallel to each other by means of at least two spacer elements 15, 20. The upper beam 5 has a flange 25 provided with a web 35. The lower beam 10 is preferably a T-beam. For strength considerations, it is important that the anchoring points of the upper and lower beams 5, 10 in relation to the respective spacer elements 15, 20 be arranged at a substantial distance from each other. However, this means that the upper beam 5 will limit the field of vision of an operator of the vehicle on which the fork lift rack 1 is mounted. In order to solve this problem, the web 35 of the upper beam 5 is made inclined, which means that the flange 25 will be displaced relative to the second beam 10. The upper beam 5 preferably has a cross-section substantially in a V-shape. This means that the web is joined to the flange 25 of the upper beam 5 at an angle a which is not 90°. Preferably this angle lies in an interval of about 40° to about 50°. The web 35 is directed into the respective spacer elements 15, 20, with the flange 25 free of the respective spacer elements 15, 20.

By virtue of the fact that the flange 25 is displaced towards the lower beam 10, the field vision of the operator is increased. The operator is provided with a larger overview of the fork members 40, 45 mounted on the fork lift rack 1, making it easier for the operator to direct the fork members 40, 45 under the object to be lifted, and place the object where it is to be left.

Figure 3:
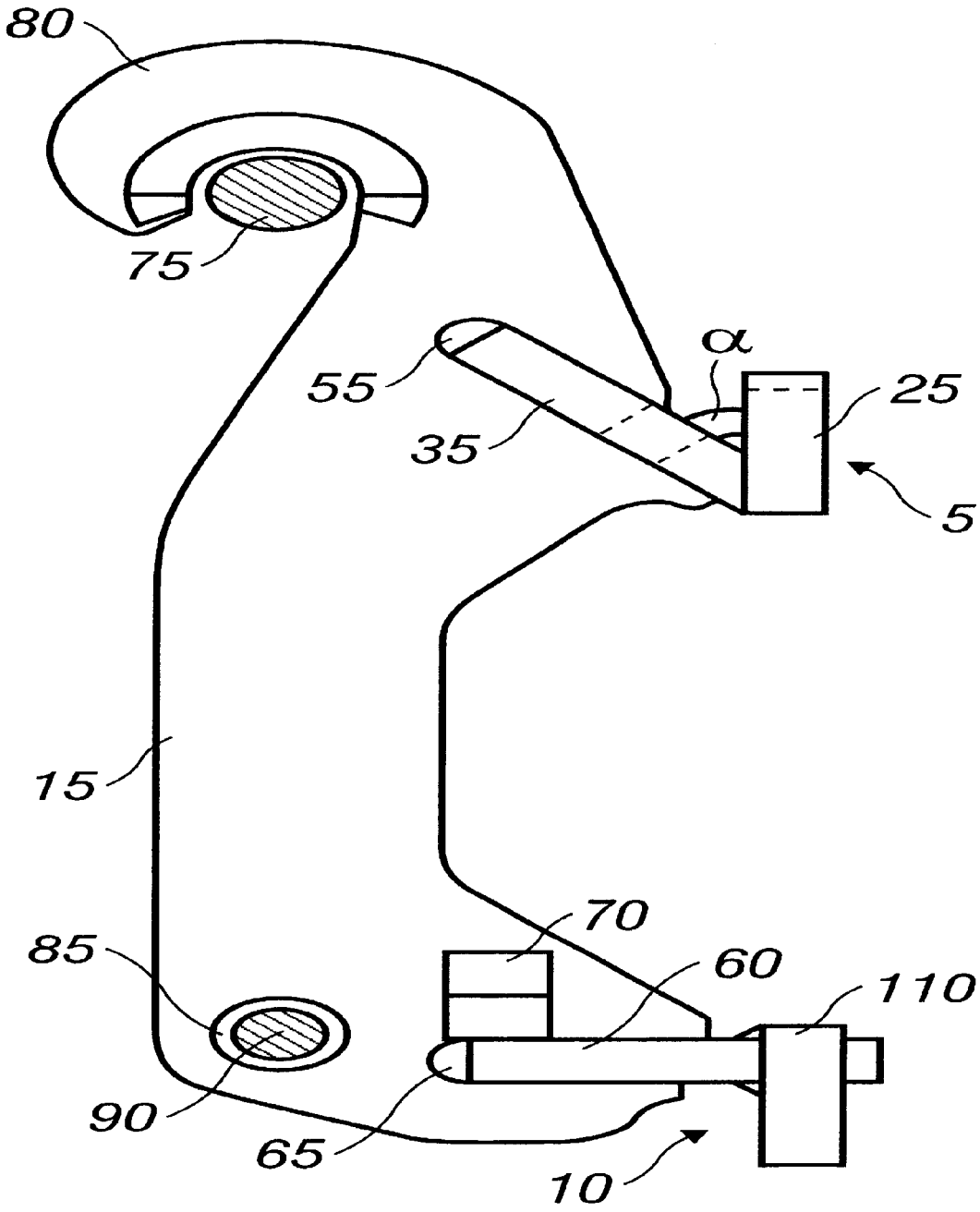
FIG. 3 illustrates a side view of a fork lift rack.
Figure 4:
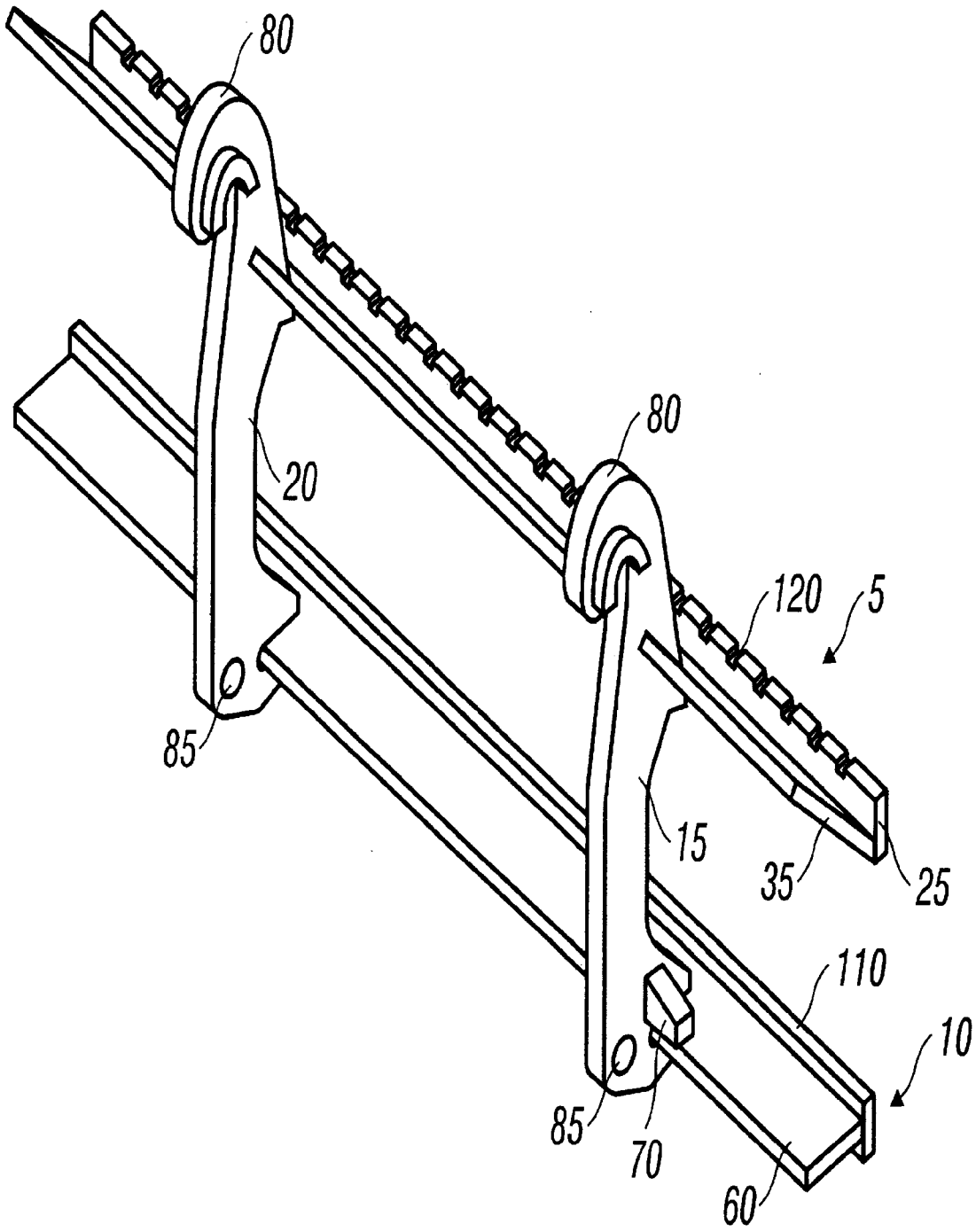
FIG. 4 illustrates a perspective view of a fork lift rack.

As can best be seen in FIGS. 3 and 4, the upper beam 5 is joined to the respective spacer elements 15, 20 by means of the web 35. The web 35 of the upper beam 5 is inserted into a slot 55 in each spacer element 15, 20. This joint provides high fatigue strength in the joint between the upper beam 5 and the spacer elements 15, 20. The fatigue strength can be increased further by rounding the bottom of the slot 55.

The web 35 of the upper beam 5 thus extends obliquely upwards towards the hook 80, and the flange 25 of the upper beam 5 extends substantially in a vertical plane. The "vertical plane" in this context means the plane perpendicular to a horizontal surface on which there rests, for example, a pallet to be lifted by means of the fork lift rack.

The lower beam 10, which as illustrated is made as a T-beam, has a web 60 that is joined to the respective spacer elements 15, 20. A second slot 65 is made in each spacer element 15, 20 into which the web 60 is inserted. In order to reduce the stress concentrations, the bottom of the second slot 65 is preferably rounded. A heel 70 is arranged on each spacer element 15, 20 and is joined to both the web 60 and the respective spacer elements 15, 20.

The spacer elements 15, 20 are arranged at a substantial distance from each other and form, together with the upper and lower beam 5, 10, a frame. The distance between the spacer elements 15, 20 is also dependent on the design of the lifting mechanism 75 to which the fork lift rack 1 is to be coupled.

Referring to FIG. 3, each spacer element 15, 20 comprises an attachment means or connector in the form of a hook 80 and an opening 85. The hook 80 is designed to be hooked onto a lifting mechanism 75 having a pin 90 designed to be inserted into the opening 85.

As can be seen best in FIG. 1, there are preferably mounted on the fork lift rack 1 two fork members 40, 45, such as pallet fork members, each having first and second legs 95, 100. The first 95 and second 100 legs form substantially a right angle with each other, the first leg 95 having a coupler or coupling means 105 for coupling together with the upper and lower beams 5, 10 of the fork lift rack 1. The coupler or coupling means 105 is joined to the first leg 95 and is coupled to the flange 25 of the upper beam S. At the same time, the first leg 95 abuts against the flange 110 of the lower beam 10. The second leg 100 has a load or load bearing surface 115 for carrying a load.

In order to lift objects of different shapes, the distance between the fork members 40, 45 can be changed. The flange 25 of the upper beam 5 comprises a plurality of notches 120 along its length. These notches are intended to determine the positions of the fork members 40, 45 and cooperate with the coupling means 105 to laterally fix the fork members 40, 45. For example, if long objects are to be lifted, it is suitable that the distance between the fork members 40, 45 be great in order to distribute the load. Preferably both the upper and lower beams 5, 10 extend laterally to either side of each spacer element 15, 20, making possible a large distance between the fork members 40, 45. If smaller objects are to be lifted, the distance between the fork members 40, 45 can be decreased.

Figure 2:
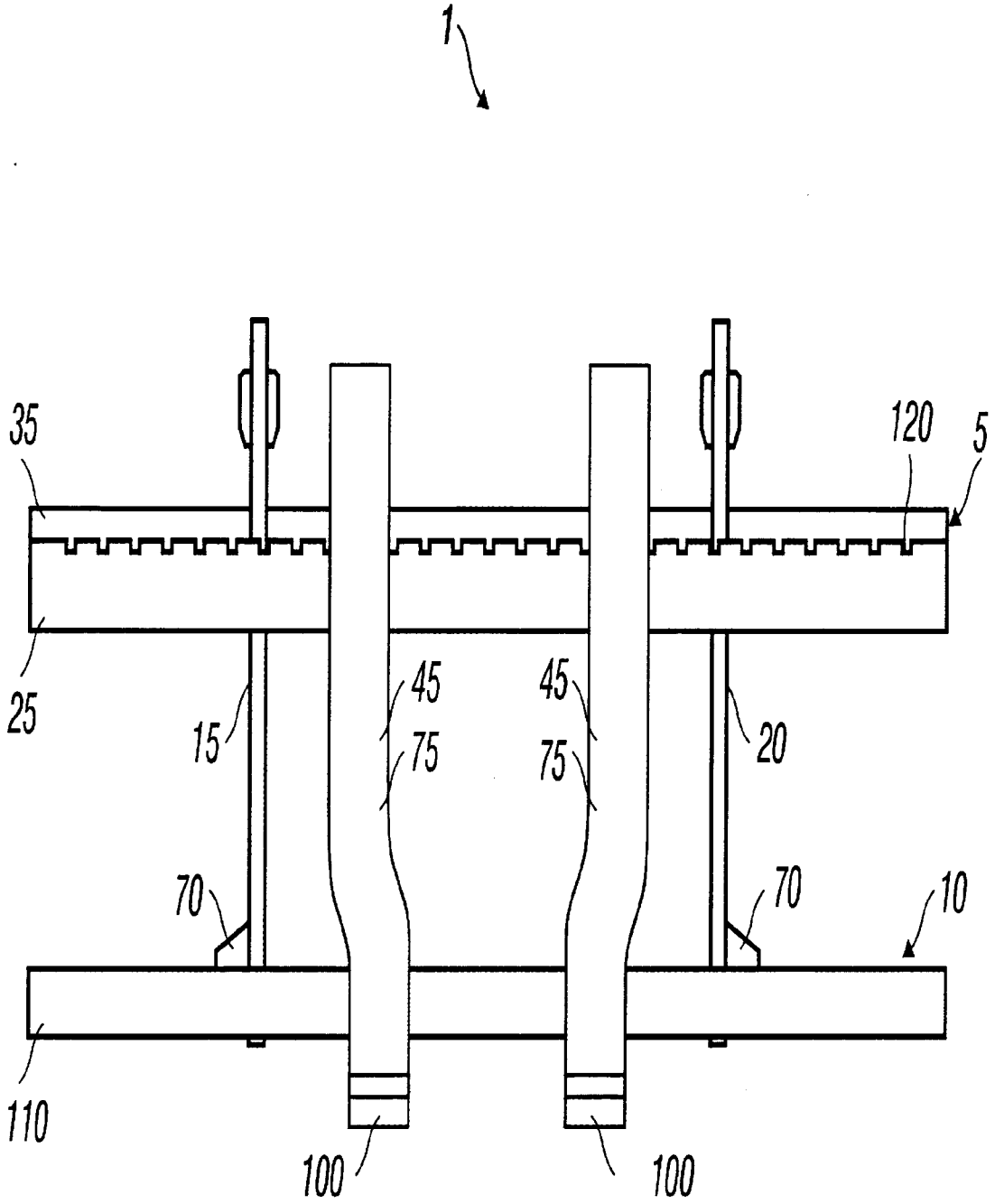
FIG. 2 illustrates a front view of a fork lift rack with fork members mounted on the rack.

When the distance between the fork members 40, 45 is small, the field of vision of the operator will be limited by the firs legs 95 of the fork members 40, 45. In order to solve this problem, the first and second legs 5, 100 extend in separate vertical planes. The fork members 40, 45 are designed such that the distance between the first legs 95 is greater than the distance between the second legs 100 when the two forks are mounted in place on the rack. This relationship may be best appreciated in FIGS. 1 and 2 wherein a fork member arrangement including a fork lift rack 1 that is installable upon a carrying vehicle is shown with two fork members 40, 45 mounted thereupon. The right-hand fork member 45 is shown to be located on the right side (as viewed from the front side of the lift arrangement and as depicted in both FIGS. 1 and 2) of the lengthwise center-position of the rack 1, as well as to the right of the left-hand fork member 40. Similarly, the le -hand fork member 40 is shown located on the left side of the lengthwise center-position of the rack 1, and to the left of the right-hand fork member 45. As may be appreciated from these figures, an upper part of the first leg 95 of the right-hand fork member 45 is rightwardly displaced with respect to the second leg 100 of the right-hand fork member 45 thereby facilitating an operator's view of the second leg 100 of the right-hand fork member 45 when that fork member 45 is mounted upon a fork lift carrying vehicle. The left-hand fork member 40 is similarly configured, but as a mirror image to the right-hand fork member 45 when viewed as shown in FIGS. 1 and 2.

Figure 5:
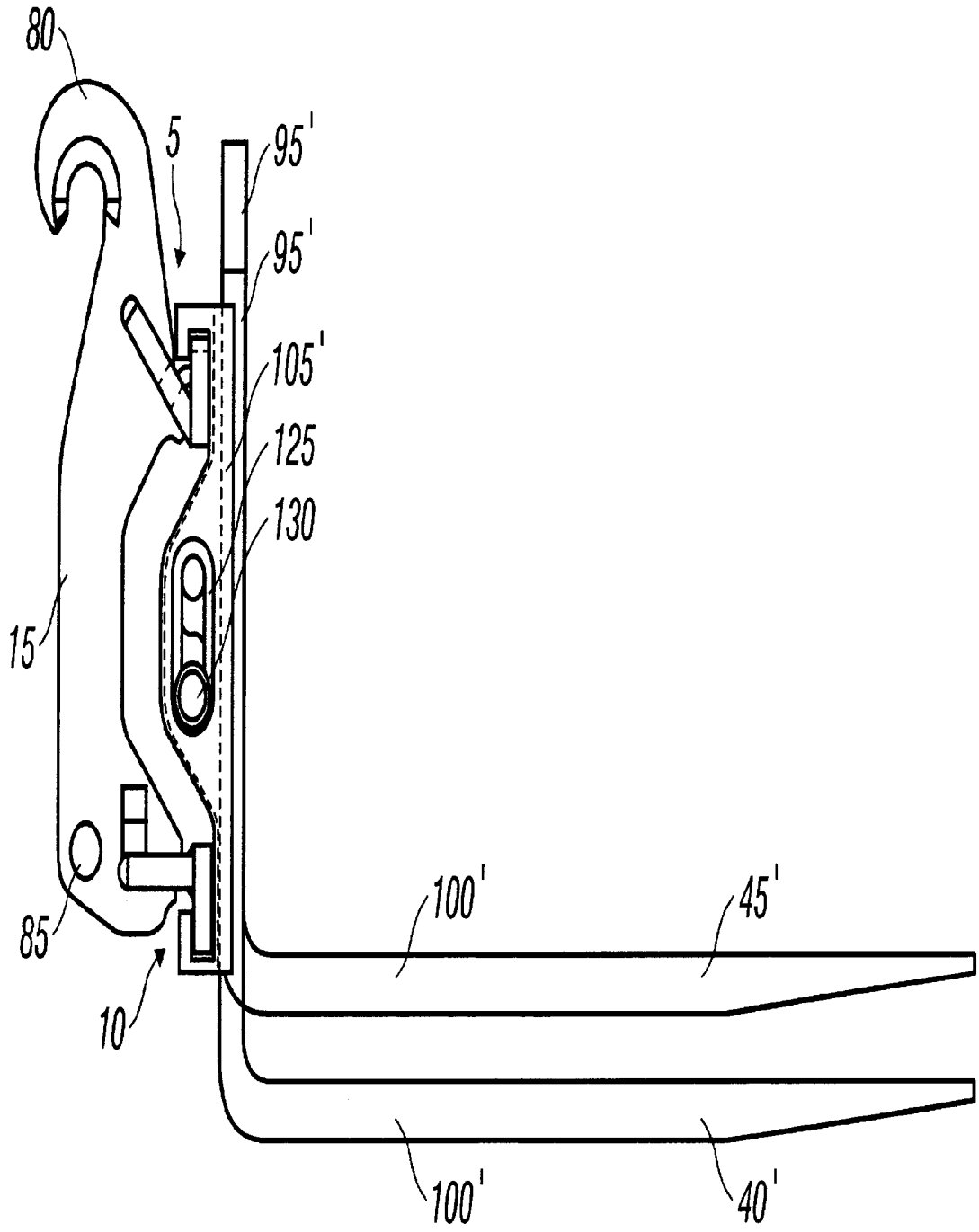
FIG. 5 illustrates a side view of an alternative embodiment of a fork lift rack with fork members mounted on the rack and being displaceable relative to a coupling means.

According to an alternative embodiment illustrated in FIG. 5, the respective fork members 40', 45' can be made displaceable relative to the coupler or coupling means 105' in the longitudinal direction of the first le 95'. The coupler or coupling means 105' is coupled to the upper and lower beams 5, 10. The coupling means 105' has an elongated opening 125 in which a pin 130 mounted on the first leg 95 can move. This arrangement enables the fork members 40', 45' to be inserted under an object which is placed on an inclined surface without having to tip the entire fork lift rack 1 to the same inclination as the surface. When the fork lift rack 1 with the fork members 40', 45' is lowered against the inclined surface, one of the fork members 40', 45' will strike the surface before the o her fork member 40',45' does. The fork 40', 45' which first strikes the surface will be displace relative to the coupling means 105' and, thus, also relative to the fork lift rack 1. When the for lift rack 1 is lowered further, the other fork member 40', 45' will strike the surface. Thereafter the lowering of the fork lift rack 1 will cease and the fork members 40', 45' will be pushed in under the object to be lifted. FIG. 5 shows the fork members 40', 45' in staggered position. Second legs 100' are also shown in FIG. 5.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A lift arrangement for a fork lift rack having an upper beam, a lower beam and at least two spacer elements for fixing the upper and lower beam at a distance from and substantially parallel to each other, the beams being adapted for carrying load bearing fork members wherein the upper beam is formed by a web and a flange that extend in the longitudinal direction of the beam, the flange forming a front part of the beam for carrying the fork members, and the web being joined to the flange and directed backwards and upwards from the flange, the lift arrangement comprising:

a pair of fork members mounted on the fork lift rack, each of which comprises a first leg and a second leg forming a substantially right angle to each other, wherein the first leg has at least one coupler connected to the fork lift rack and the second leg has a load surface for carrying a load, wherein an upper part of the first leg of each of the fork members is displaced at a distance sideways of a lower part of the first leg that is connected to the second leg, so that the distance between the upper part of the first legs is larger than the distance between the second legs.

2. The lift arrangement according to claim 1 wherein the flange is substantially flat and extends in a substantially vertical plane.

3. The lift arrangement according to claim 1 wherein the web is substantially flat.

4. The lift arrangement according to claim 3 wherein the web is inclined in relation to the flange with an angle $\alpha$ in the range of about 20° to about 70°.

5. The lift arrangement according to claim 4 wherein the web is inclined in relation to the flange with an angle $\alpha$ in the range of about 30° to about 60°.

6. The lift arrangement according to claim 5 wherein the web is inclined in relation to the flange with an angle $\alpha$ in the range of about 40° to about 50°.

7. The lift arrangement according to claim 1 wherein the web has a larger width than the flange of the upper beam.

8. The lift arrangement according to claim 1 wherein the upper beam has a V-shaped cross section.

9. The lift arrangement according to claim 1 wherein the spacer elements are connected to the flange.

10. The lift arrangement according to claim 1 wherein the web is inserted in a slot arranged in each spacer element.

11. The lift arrangement according to claim 1 wherein the flange has a plurality of notches along its length for determining the position of the fork members.

12. The lift arrangement according to claim 1 wherein the lower beam is a T-beam.

13. The lift arrangement according to claim 1 wherein the upper and lower part of the first leg of each of the fork members extend in the same plane and the first leg has a curved part connecting the upper and lower part.

14. The lift arrangement according to claim 1 wherein the upper part of the first leg of each of said fork members extends in a direction substantially perpendicular to the load bearing surface.

* * * * *